US009166333B2

(12) United States Patent
Shindo et al.

(10) Patent No.: US 9,166,333 B2
(45) **Date of Patent: *Oct. 20, 2015**

(54) CONNECTOR

(71) Applicant: J.S.T. MFG. CO., LTD., Osaka-shi (JP)

(72) Inventors: Satoru Shindo, Miyoshi (JP); Shinji Tasaka, Miyoshi (JP); Takamasa Yagi, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/177,605

(22) Filed: Feb. 11, 2014

(65) Prior Publication Data

US 2014/0273603 A1 Sep. 18, 2014

(30) Foreign Application Priority Data

Feb. 12, 2013 (JP) ..... 2013-024962

(51) Int. Cl.

| | |
|---|---|
| ***H01R 13/64*** | (2006.01) |
| ***H01R 13/629*** | (2006.01) |
| ***H01R 13/631*** | (2006.01) |
| ***H01R 43/26*** | (2006.01) |
| *H01R 13/533* | (2006.01) |

(52) U.S. Cl.

CPC ..... *H01R 13/629* (2013.01); *H01R 13/6315* (2013.01); *H01R 43/26* (2013.01); *H01R 13/533* (2013.01)

(58) Field of Classification Search

CPC ..... H01R 13/631
USPC ..... 439/263, 381, 380, 137, 136, 374
See application file for complete search history.

(56) References Cited

U.S. PATENT DOCUMENTS

| | | | | | |
|---|---|---|---|---|---|
| 6,004,140 | A | * | 12/1999 | Kato et al. | 439/65 |
| 6,146,184 | A | * | 11/2000 | Wilson et al. | 439/374 |
| 6,672,908 | B2 | * | 1/2004 | Okabe et al. | 439/682 |
| 2003/0188882 | A1 | | 10/2003 | Asao et al. | |

(Continued)

FOREIGN PATENT DOCUMENTS

| | | | |
|---|---|---|---|
| JP | 10-308570 | A | 11/1998 |
| JP | 11-144806 | A | 5/1999 |

(Continued)

OTHER PUBLICATIONS

Extended European Search Report issued May 14, 2014 in counterpart application No. 14154609.3.

(Continued)

*Primary Examiner* — Phuong Dinh
(74) *Attorney, Agent, or Firm* — Kratz, Quintos & Hanson, LLP

(57) ABSTRACT

It is an object of the present invention to prevent damages to a contact. A contact 130 having penetrated the substrate 110 is inserted into the female housing 30, and is electrically connected to a female contact 40. When the slider 1 is pressed down ward during this state, the first movable body 70 and the second movable body 80 are pressed down by the slider 1. This causes a lower stage 73 of the first movable body 70 and a lower stage 83 of the second movable body 80 to move below an upper wall 94 of the housing 90, and outer surfaces of the lower stages 73 and 83 no longer contact the upper wall 94. Then, expansion of a spring 120 moves the first movable body 70 and the second movable body 80 away from the contact 130.

12 Claims, 8 Drawing Sheets

CLOSE STATE

(56) References Cited

U.S. PATENT DOCUMENTS

2014/0308839 A1* 10/2014 Shindo et al. ..... 439/353
2014/0308851 A1* 10/2014 Shindo et al. ..... 439/625

FOREIGN PATENT DOCUMENTS

JP 2010-146873 A1 7/2010
WO 2009/111567 A2 9/2009

OTHER PUBLICATIONS

Extended European Search Report issued Jul. 4, 2014 in counterpart application No. 14164142.3.
Extended European Search Report issued Jul. 4, 2014 in counterpart application No. 14164141.5.

* cited by examiner

FIG.5A CLOSE STATE
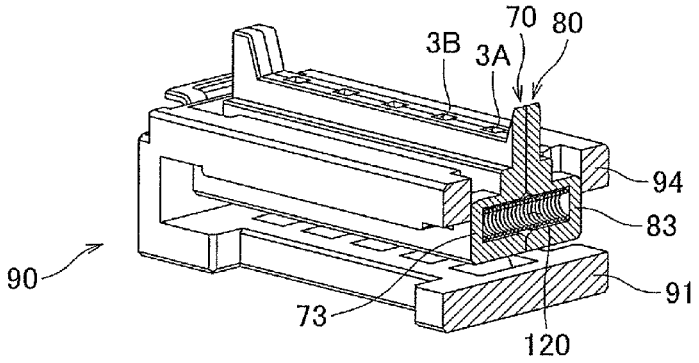
FIG.5B SEPARATED STATE
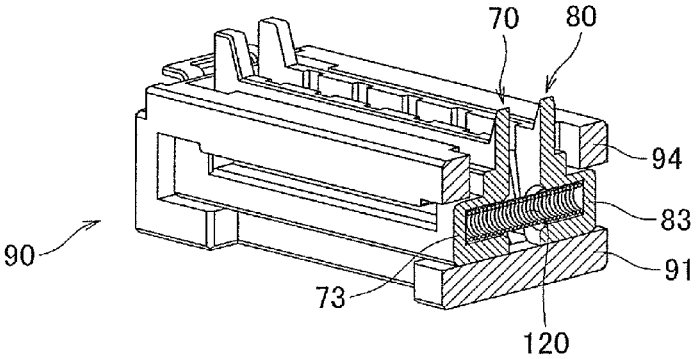
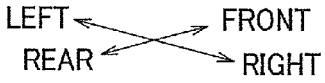

FIG.6A CLOSE STATE
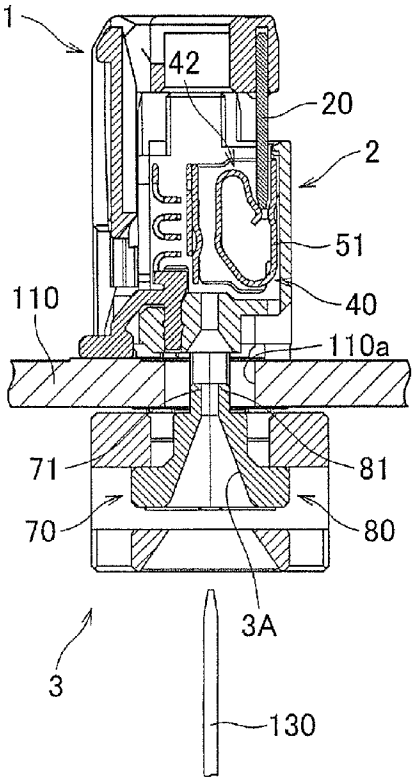
FIG.6B CLOSE STATE
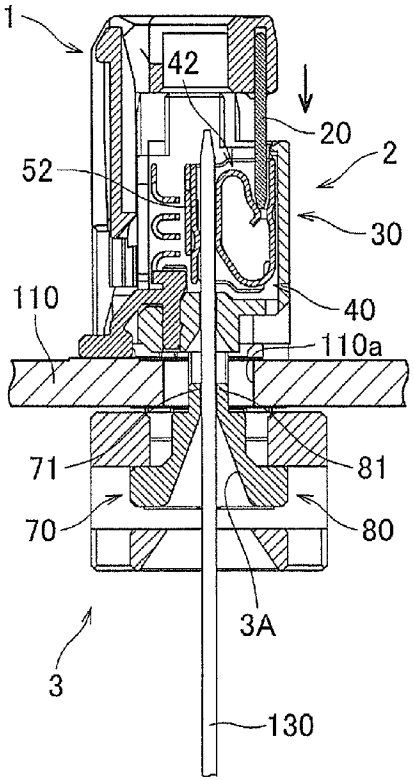
FIG.6C SEPARATED STATE
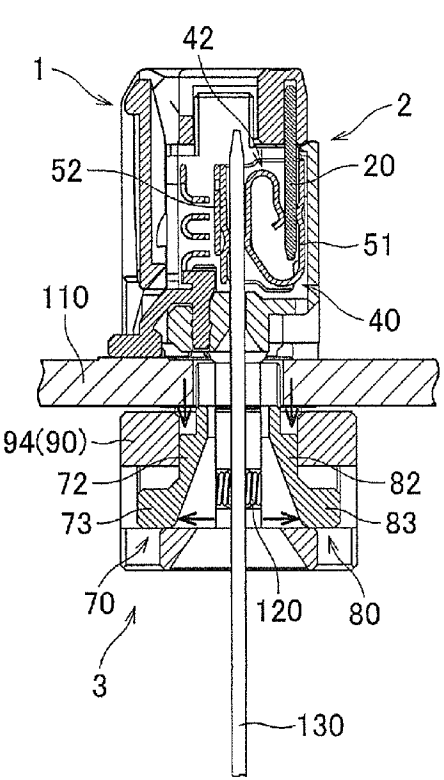

FIG.8B SEPARATED STATE
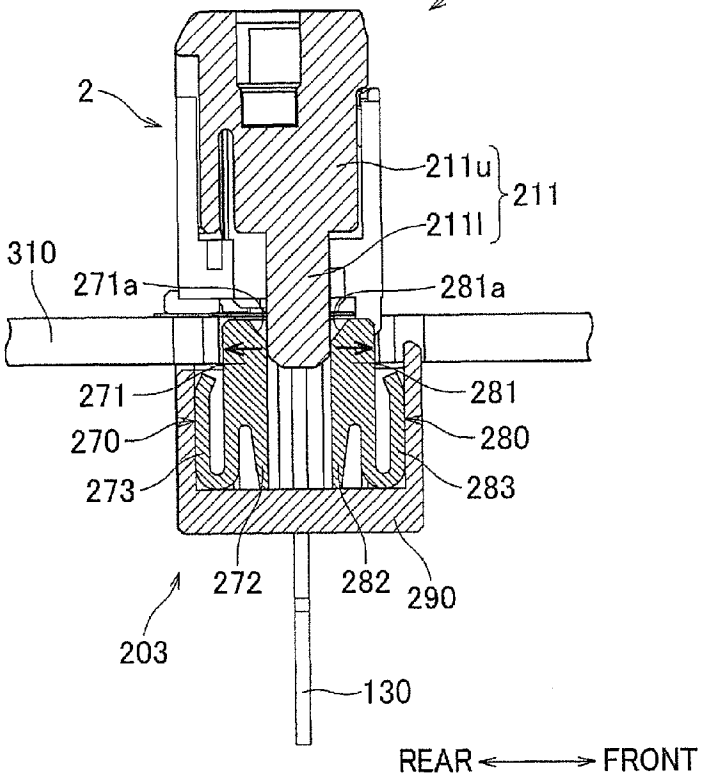
FIG.8A CLOSE STATE
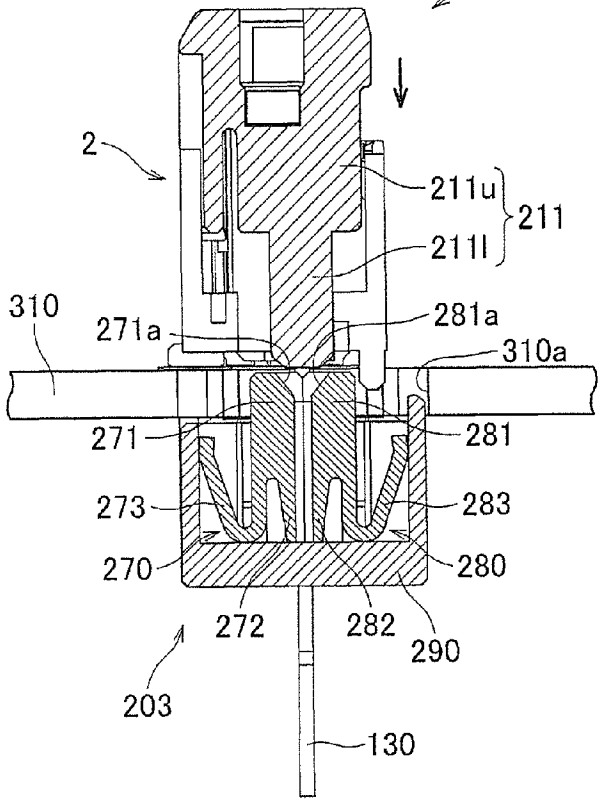

CONNECTOR

CROSS REFERENCE TO RELATED APPLICATION

The present application claims priority from Japanese Patent Application No. 2013-024962, which was filed on Feb. 12, 2013, the disclosure of which is herein incorporated by reference in its entirety.

BACKGROUND OF THE INVENTION

1. Technical Field

The present invention relates to a connector including a housing that leads a contact into a contact insertion hole formed on a substrate.

2. Background Art

As a connector mounted in an automobile or the like, there has been known one such that a counterpart contact is inserted from underneath into a connector placed on a substrate through the substrate. The counterpart contact passes through a contact insertion hole formed on the substrate and goes into the connector. However, misalignment of the counterpart contact and the contact insertion hole, due to the tolerance or the like at the time of manufacturing, the counterpart contact may not be smoothly inserted into the contact insertion hole. Such a problem becomes a more significant concern, with an increase in the number of counterpart contacts.

To address this issue, Japanese Unexamined Patent Publication No. 146873/2010 (Tokukai 2010-146873; hereinafter PTL 1) discloses a housing which guides a counterpart contact into a contact insertion hole. The housing has a guide hole (through hole). This guide hole is arranged below the contact insertion hole, when the housing is arranged below the substrate. The guide hole has a funnel-like shape such that its diameter increases with an increase in the distance from the contact insertion hole. The diameter at the lower end of the guide hole is larger than the diameter of the contact insertion hole. This facilitates insertion of the counterpart contact into the guide hole despite misalignment of the counterpart contact and the contact insertion hole due to tolerance or the like at the time of manufacturing. The counterpart contact is then guided to the contact insertion hole through the guide hole.

SUMMARY OF THE INVENTION

Technical Problem

The above-described guide housing facilitates guiding of the counterpart contact from the guide hole to the contact insertion hole by making the diameter of the upper end of the guide hole substantially the same as that of the counterpart contact. Thus, while the counterpart contact is in the guide hole, the counterpart contact is close to the inner circumferential surface of the guide housing, which surfaces defines the guide hole.

Areas at or nearby a power supply and a source of power (engine or the like) for an automobile, where the above-mentioned connector is mounted are easily subject to vibration. As such, the guide housing also vibrate with the vibration. Since the counterpart contact is close to the inner circumferential surface of the guide housing, vibration of the guide housing may be transferred to the counterpart contact, thus damaging the counterpart contact. If the substrate also vibrates and resonates with vibration of the guide housing, the vibration transferred to the counterpart contact is enhanced. In this case, the counterpart contact is more easily damaged.

In view of the above problem, the present invention is made and it is an object of the present invention to provide a connector capable of preventing damages to a counterpart contact.

Technical Solution

An aspect of the present invention is a connector including: a first connector and a second connector interposing therebetween a substrate, the first connector and the second connector being arranged across from each other over the substrate, and a slider movably attached to the second connector.

The first connector includes: a first housing configured to accommodate a first movable body and a second movable body to interpose a first contact extending in a direction perpendicular to the substrate, and a biasing member capable of biasing the first movable body and the second movable body in directions away from each other. The first movable body and the second movable body accommodated in the first housing are capable of making a transition from a close state to a separated state, the close state being a state in which movement of the first movable body and the second movable body in directions away from each other is restricted by the first housing, while the first movable body and the second movable body are biased by the biasing member, the separated state being a state in which the first movable body and the second movable body are made more distant from the second connector and from each other than the close state by means of the biasing member. The first movable body and the second movable body, during the close state, form a contact insertion hole whose diameter becomes smaller as it gets closer to the substrate, and whose smallest diameter is not smaller than a diameter of the first contact.

The second connector includes: a second housing, and a second contact attached to the second housing, which contact is to be electrically connected to the first contact having penetrated the contact insertion hole and the substrate.

Moving the slider while the first contact penetrates the contact insertion hole and the substrate and is electrically connected to the second contact causes transition from the close state to the separated state of the first movable body and the second movable body.

With the above structure, bringing the first movable body and the second movable body into the separated state while the first contact and the second contact are electrically connected moves away the first movable body and the second movable body from the first contact. Thus, even when the first housing is vibrated, or even when the first housing and the substrate are vibrated and resonance takes place, the vibration is prevented from being transferred to the first contact. It is therefore possible to prevent damages to the first contact.

The present invention is preferably adapted so that pressing the first movable body and the second movable body with a use of the slider causes the transition from the close state to the separated state of the first movable body and the second movable body. With the structure, simply pressing the first movable body and the second movable body reliably moves away the first movable body and the second movable body from the first contact.

Another aspect of the present invention is a connector including a first connector and a second connector interposing therebetween a substrate, the first connector and the second connector being arranged across from each other over the substrate, and a slider movably attached to the second connector. The first connector includes a first housing configured to accommodate a first movable body and a second movable body which are disposed so that a first contact extending in a direction perpendicular to the substrate is interposed between the first movable body and the second movable body, and a biasing member capable of biasing the first movable body and the second movable body in directions toward each other. The first movable body and the second movable body accommodated in the first housing are capable of making a transition from a close state to a separated state, the close state being a state in which the first movable body and the second movable body are biased by the biasing member, the separated state being a state in which the first movable body and the second movable body are made more distant from each other than the close state, opposing against the force for biasing the first movable body and the second movable body exerted by the biasing member. The first movable body and the second movable body, during the close state, form a contact insertion hole whose diameter becomes smaller as it gets closer to the substrate, and whose smallest diameter is not smaller than a diameter of the first contact.

The second connector includes a second housing, and a second contact attached to the second housing, which contact is to be electrically connected to the first contact having penetrated the contact insertion hole and the substrate.

Moving the slider while the first contact penetrates the contact insertion hole and the substrate and is electrically connected to the second contact causes transition from the close state to the separated state of the first movable body and the second movable body.

With the above structure, bringing the first movable body and the second movable body into the separated state while the first contact and the second contact are electrically connected moves away the first movable body and the second movable body from the first contact. Thus, even when the first housing is vibrated, or even when the first housing and the substrate are vibrated and resonance takes place, the vibration is prevented from being transferred to the first contact. It is therefore possible to prevent damages to the first contact.

The above aspect of present invention is preferably adapted so that pressing at least one of the first movable body and the second movable body with a use of the slider causes the transition from the close state to the separated state of the first movable body and the second movable body. With the above structure, it is possible to reliably bring the first movable body and the second movable body into the separated state simply by pressing at least one of the first movable body and the second movable body.

The aspects of present invention are preferably adapted so that the biasing member is accommodated in the first housing, and the first housing has a through hole formed in a position to face the biasing member. With the structure, whether or not the biasing member is accommodated in the first housing is confirmed through the through hole. Further, formation of the through hole on the first housing is also advantageous in that the weight of the first housing is reduced and that it makes it easier to carry the first housing, thus contributing to efficient assembling of the connector.

The aspects of present invention preferably further include an insertion member disposed between the first housing and the biasing member, in a position to overlap at least a portion of the through hole. Since the insertion member closes the through hole, it is possible to restrain foreign materials from entering the first housing. Further, with the through hole formed on the insertion member, whether or not the biasing member is accommodated in the first housing is confirmed through the through hole.

Advantageous Effects

With the connector of the present invention, the first movable body and the second movable body are moved away from the first contact while the first contact and the second contact are electrically connected. Therefore, the first contact is prevented from vibrating even when the first housing is vibrated. Thus, damages to the first contact are prevented.

BRIEF DESCRIPTION OF THE DRAWINGS

FIG. 5A is a cross sectional perspective diagram of the guide connector in a close state.

FIG. 5B is a perspective diagram of the guide connector in a separated state.

FIGS. 6A, 6B and 6C are cross sectional views showing a sequence of assembling the connector.

FIG. 8A is a cross sectional view of a connector related to a second embodiment of the present invention, and shows the connector in a close state.

FIG. 8B is a cross sectional view of the connector related to the second embodiment of the present invention, and shows the connector in a separated state.

DESCRIPTION OF THE PREFERRED EMBODIMENTS

First Embodiment

The following describes a first embodiment of the present invention.

Figure 1:
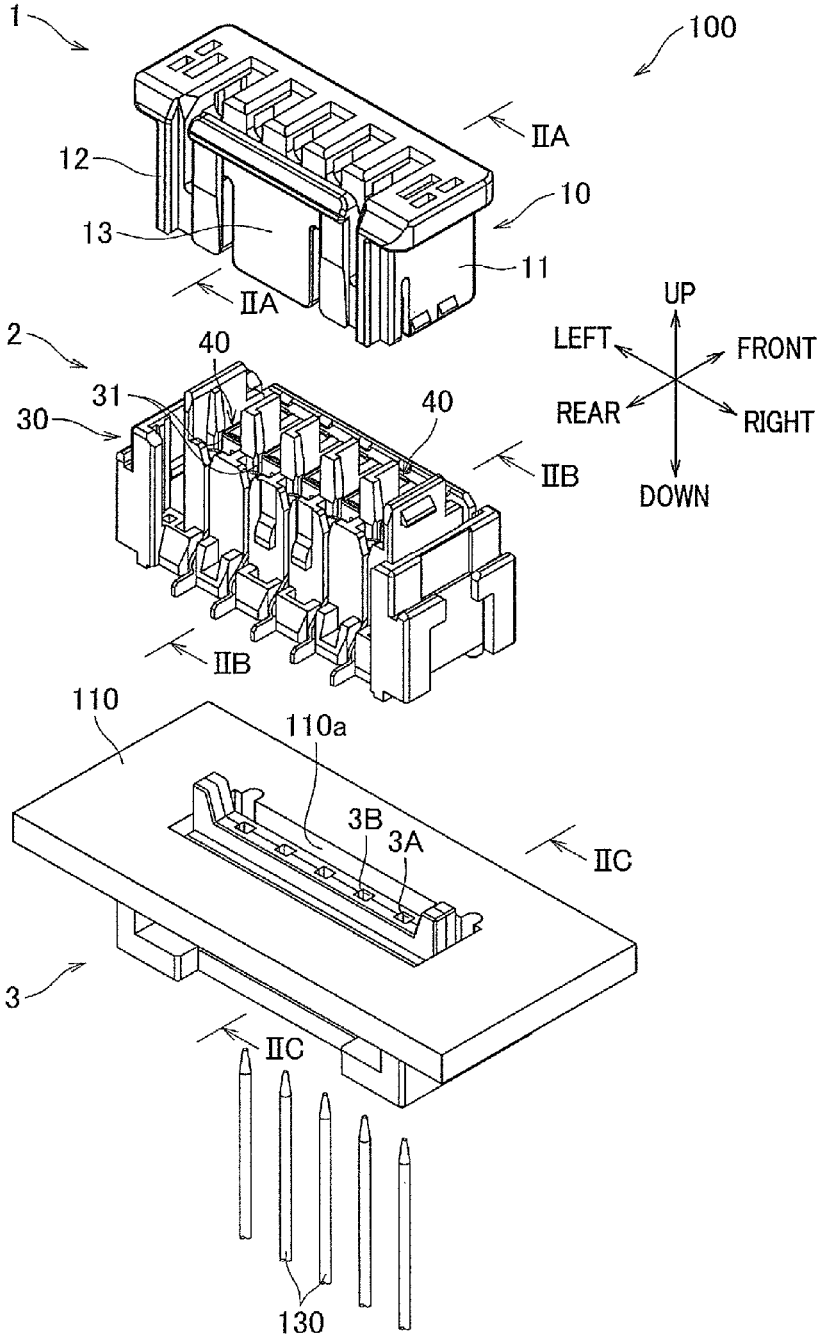
FIG. 1 is an exploded perspective diagram of a connector related to a first embodiment of the present invention.

As shown in FIG. 1, a connector 100 includes a substrate 110, a slider 1 and a female connector (second connector) 2 arranged above the substrate 110, and a guide connector (first connector) 3 arranged below the substrate 110. The slider 1 is attached to the female connector 2 and movable in up/down directions (see FIG. 6). Further, the substrate 110 has a substantially polyangular insertion hole 110*a*. To the insertion hole 110*a* is arranged an upper end of the guide connector (first connector) 3.

(Slider)

As shown in FIG. 1, the slider 1 includes a substantially box-shaped housing 10 which is formed by an insulative resin. The housing 10 includes a right wall 11, a left wall 12, a front wall, and a back wall 13 which form therein a space for accommodating the female connector 2 (see FIG. 2A).

Figure 2A:
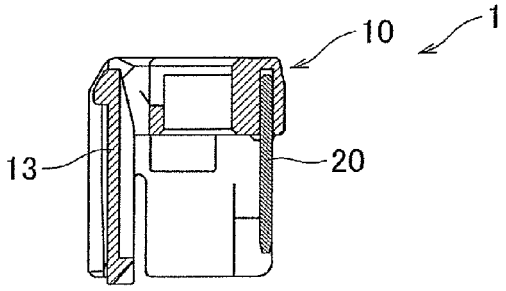
FIG. 2A is a cross sectional view of a slider taken along the line IIA-IIA of FIG. 1.

As shown in FIG. 2A, a lengthy pin 20 is mounted in the housing 10. The pin 20 extends in the up/down directions and is inserted in the female connector 2.

(Female Connector)

Figure 2B:
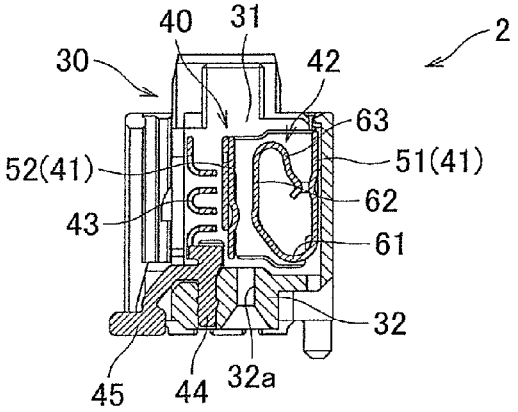
FIG. 2B is a cross sectional view of a female connector taken along the line IIB-IIB of FIG. 1.

As shown in FIG. 1 and FIG. 2B, the female connector 2 includes a substantially polyangular female housing (second housing) 30 made of an insulative resin, and five female contacts (second contact) 40 mounted to the female housing 30.

<Female Housing>

As shown in FIG. 1, the female housing 30 has five spaces (accommodation chambers) 31 each capable of accommodating a female contact 40. These accommodation chambers 31 are aligned in left/right directions. The upper end of the accommodation chamber 31 is opened. From this opening at the upper end, the pin 20 of the slider 1 is inserted into the accommodation chamber 31 (see FIG. 2B).

To a bottom wall 32 of the female housing 30 is formed a through hole 32*a* extended in the up/down directions, as shown in FIG. 2B. To this through hole 32*a* is inserted the contact 130 having penetrated through the substrate 110 from the bottom. The through hole 32*a* has an upper area in which the diameter is constant, and a lower area in which the diameter is varied. The lower area is tapered so its diameter increases with an increase in a distance from the upper area. Such a structure facilitates insertion of the contact 130 into the accommodation chamber 31 subsequent to the through hole 32*a*.

<Female Contact>

As shown in FIG. 1 and FIG. 2B, the female contact 40 includes: a polyangular tubular portion 41 whose upper and lower ends are opened; a bent portion 42 bent to extend around the inner periphery of the polyangular tubular portion 41 (see FIG. 2B); an elastic portion 43 which elastically displaces in the up/down directions; and a fixed portion 44 and the mounting portion 45 disposed outside the accommodation chamber 31. The fixed portion 44 extends downwards from the lower end of the elastic portion 43, and is fixed to the bottom wall 32 of the female housing 30. Further, the mounting portion 45 extends obliquely downwards from a midway portion of the fixed portion 44, and is soldered to the substrate 110.

As shown in FIG. 2B, the polyangular tubular portion 41 includes a front wall portion 51 and a back wall portion 52 facing each other relative to front/rear directions. The front wall portion 51 and the back wall portion 52 each has a projection projecting in a direction towards the opposing surface.

The bent portion 42 includes a lower curved portion 61 extended downwards from the front wall portion 51 so as to form a convex downward; a straight portion 62 extended upwards from the lower curved portion 61, and a projection 63 extended upwards from the straight portion 62 towards the back wall portion 52 while forming a convex upward. Between the projection of the front wall portion 51 and the projection 63 is inserted a pin 20 of the slider 1 (see FIG. 2A). Between the projection of the back wall portion 52 and the straight portion 62 is inserted the contact 130 (see FIG. 2C).

(Guide Connector)

Figure 2C:
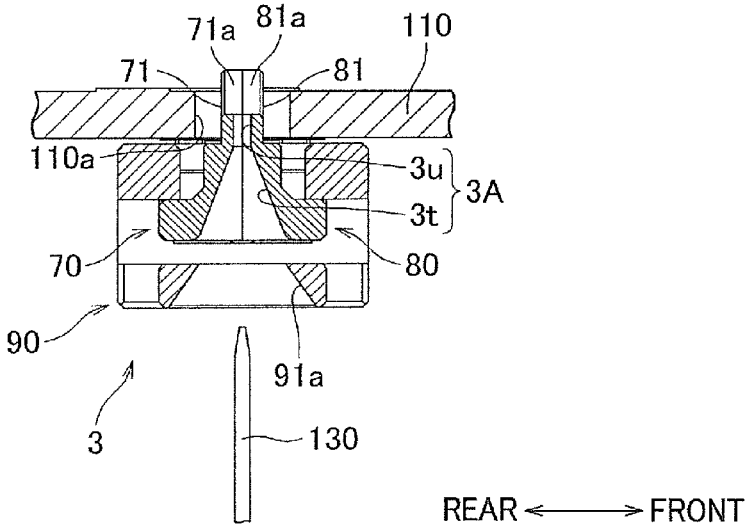
FIG. 2C is a cross sectional view of a substrate and a guide connector, taken along the line IIC-IIC of FIG. 1.
Figure 3:
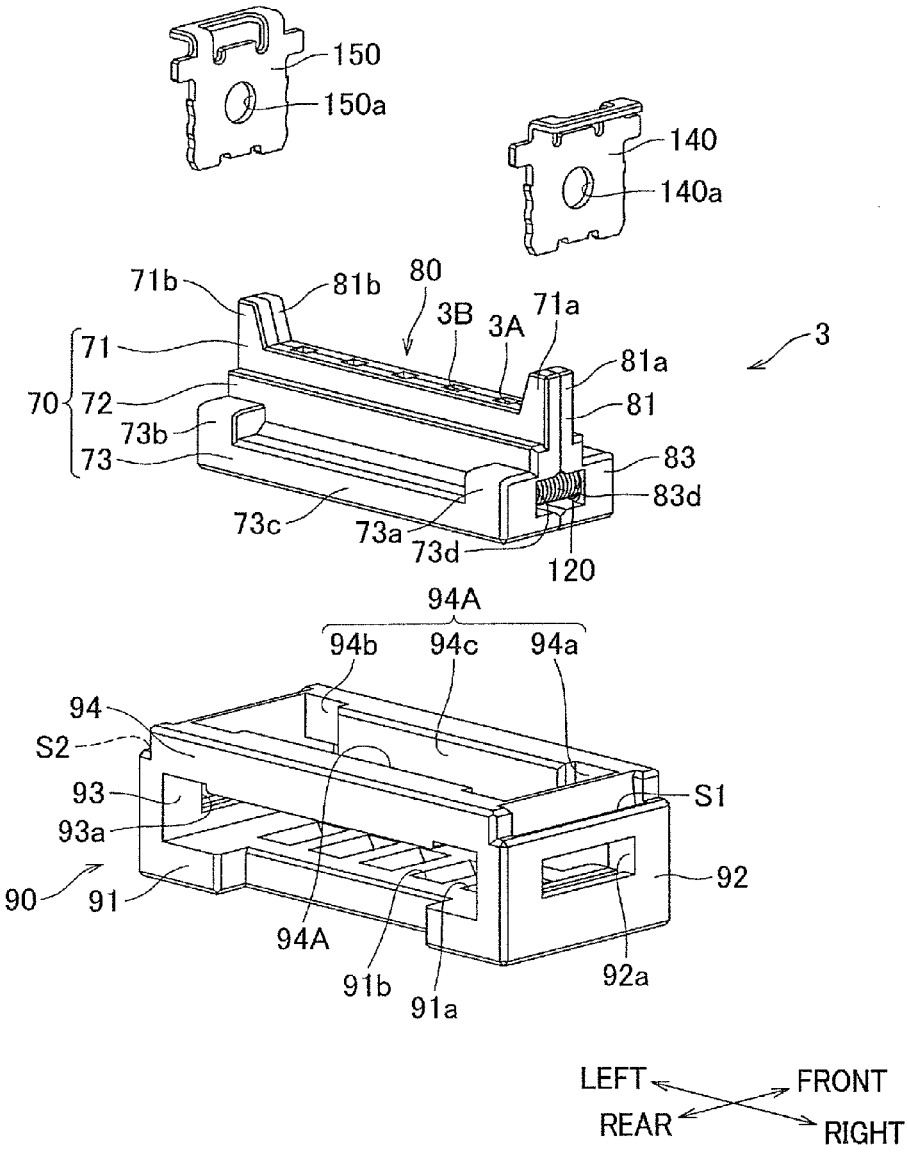
FIG. 3 is an exploded perspective diagram of the guide connector.

As shown in FIG. 2C and FIG. 3, the guide connector 3 includes a first movable body 70 and a second movable body 80 facing each other relative to the front/rear directions, and a substantially a box-shaped housing (first housing) 90 configured to accommodate these bodies. The first movable body 70, the second movable body 80, and the housing 90 are all made of an insulative resin. As shown in FIG. 3, between the first movable body 70 and the second movable body 80 is disposed two spring (biasing members) 120. One of the springs (biasing members) 120 is disposed on a right end portion of the guide connector 3; the other spring (biasing member) 120 on the left end portion of the guide connector 3. The first movable body 70 and the second movable body 80 have substantially the same structure, and are symmetrically arranged on the front and rear sides. Note that the following description mainly deals with the first movable body 70, and description of the second movable body 80 is omitted as needed.

<First Movable Body, Second Movable Body>

As shown in FIG. 3, each of the first movable body 70 and the second movable body 80 has a side portion formed in a stairway-like shape having three stages (upper stage, middle stage, lower stage) on the opposite side of the surface facing its counterpart.

Figure 4A:
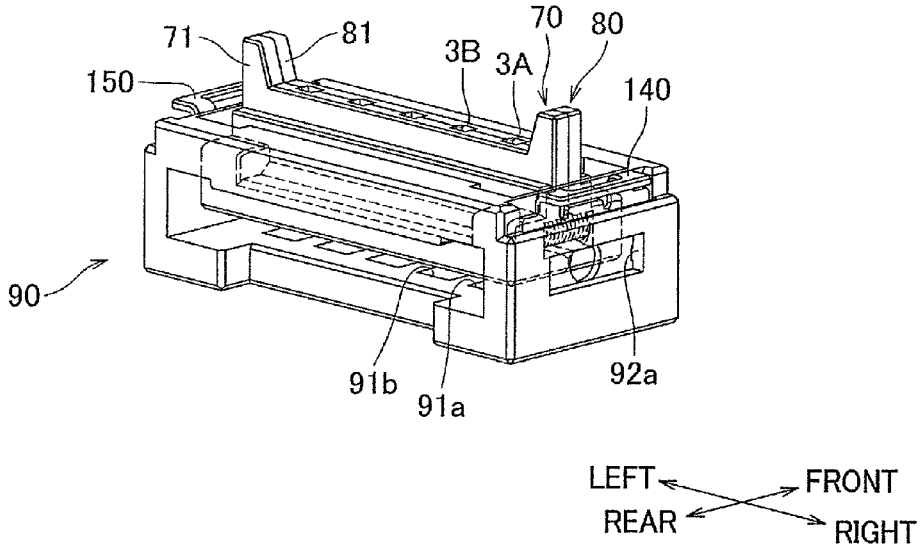
FIG. 4A is a perspective diagram of the guide connector assembled, providing a view from above.

On the right end portion and the left end portion of the upper stage 71 (81) are formed projections 71*a* and 71*b* (81*a* and 81*b*) projecting upward, respectively. When the first movable body 70 and the second movable body 80 is accommodated in the housing 90, the upper stage 71(81) is outside the housing 90 as shown in FIG. 4A and is in a later-described close state. When the guide connector 3 is attached to the substrate 110 during this state, the upper stage 71 (81) is disposed in the insertion hole 110*a* of the substrate 110, as shown in FIG. 2C. The upper ends of the projections 71*a* and 71*b* (81*a* and 81*b*) is positioned above the top surface of the substrate 110 relative to the up/down directions.

Further, as shown in FIG. 3, there is a recess formed in a middle portion of the lower stage 73 relative to the left/right directions. Thus, the right end portion 73*a* and the left end portion 73*b* of the lower stage 73 have a greater height than that of the middle portion 73*c*, relative to the up/down directions. The lower stages 73 and 83 have recesses 73*d* and 83*d*, on their inner sides facing each other, respectively. These two recesses 73*d* and 83*d* form a space for accommodating the spring 120.

Figure 4B:
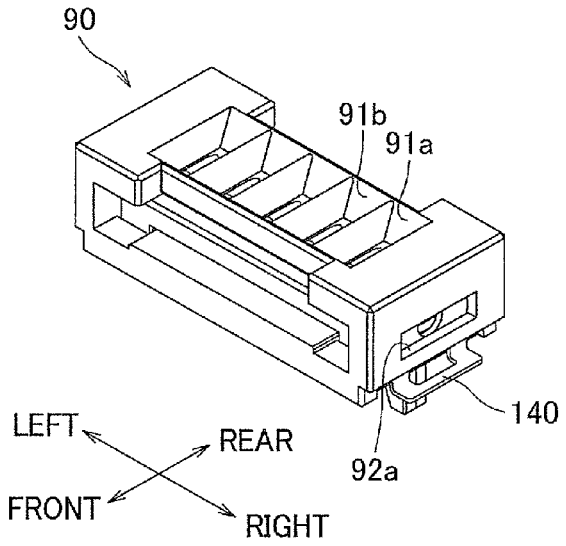
FIG. 4B is a perspective diagram of the guide connector, providing a view from the bottom.

The spring 120 is elastically deformable in the front/rear directions, and biases the first movable body 70 and the second movable body 80 in directions away from each other. Although this applies a force to move the first movable body 70 and the second movable body 80 in the directions away from each other, the first movable body 70 and the second movable body 80, while being accommodated in the housing 90, are restricted to move in those directions (see FIG. 4). From this close state (see FIG. 4, FIG. 5A) however, it is possible to make a transition to the separated state (see FIG. 5B) in which the first movable body 70 and the second movable body 80 are more distant from each other than those in the close state. Note that FIG. 2C and FIGS. 3 and 4 all show the close state.

As shown in FIG. 4 and FIG. 5A, the opposing surfaces of the first movable body 70 and the second movable body 80 substantially contact with each other during the close state. In this state, the opposing surfaces of the first movable body 70 and the second movable body 80 define five contact insertion holes (3A, 3B, and the like). As shown in FIG. 2C, the contact 130 extended in the up/down directions is inserted from the bottom of the contact insertion hole.

The contact insertion hole 3A includes a taper area 3*t* whose diameter varies to form a tapered shape, and an upper end area 3*u* where the diameter is constant (see FIG. 2C). In the taper area 3*t*, the diameter decreases with a decrease in the distance from the upper end area 3*u*. The upper end and the upper end area 3*u* of the taper area 3*t* has the smallest diameter of the contact insertion hole 3A, which is yet not smaller than the diameter of the contact 130.

When the contact 130 is inserted into the contact insertion hole 3A from the bottom, the first movable body 70 and the second movable body 80 interpose therebetween the contact 130 and are arranged across from each other over the contact 130 (see FIG. 6B).

In the separated state on the other hand, as shown in FIG. 5B, the spring 120 expands in the front/rear directions from the state of the close state, thus separating the first movable body 70 and the second movable body 80 from each other.

<Housing>

As shown in FIG. 3, the housing 90 includes a bottom wall 91, a right wall 92, a left wall 93, and an upper wall 94. Inside these are an accommodation space capable of accommodating the first movable body 70 and the second movable body 80. On the right wall 92 and the left wall 93 are through holes 92*a* and 93*a* formed through the walls in the thickness directions (left/right directions), respectively. Further, a gap s1 is formed between the right wall 92 and the upper wall 94, and a gap s2 is formed between the left wall 93 and the upper wall 94. In the gaps s1 and s2 are inserted strengthening tabs (insertion members) 140 and 150 respectively (see FIG. 4).

On the bottom wall 91 are five guide holes (91*a*, 91*b*, and the like) which formed through the wall in its thickness directions (up/down directions). The guide holes are aligned in the left/right directions. As shown in FIG. 2C, the diameter of each of the guide holes 91*a* and 91*b* increases as it becomes closer to the lower end (see FIG. 4B).

As shown in FIG. 3, the upper wall 94 has a through hole 94A in which the first movable body 70 and the second movable body 80 are fittable. The inner periphery of the upper wall 94 defining the through hole 94A has a recess sunken in the front/rear directions, in each of the right end portion and the left end portion. Therefore, a distance (distance relative to front/rear directions) between the inner portions of the right end portions facing each other and that between the inner portions of the left end portions facing each other is longer than the distance between the inner portions of the middle portions facing each other.

When the first movable body 70 and the second movable body 80 are accommodated in the housing 90, the right end portion 73*a* and the left end portion 73*b* (where corners are formed) of the lower stage 73 of the first movable body 70, and the right end portion and the left end portion of the lower stage 83 of the second movable body 80 fit in the right end portion 94*a* and the left end portion 94*b* (portions of the inner periphery portions where the separation distance is long) of the through hole 94A. Further, the middle portion 73*c* (where recess is formed) of the first movable body 70 and the middle portion of the second movable body 80 fit in the middle portion 94*c* (inner periphery portions where the separation distance is short) of the through hole 94A (see FIG. 5).

<Strengthening Tab>

As shown in FIG. 3, the strengthening tabs 140 and 150 are each a plate-member having a substantially rectangular shape, and are made of an insulative resin. Upper end portions of the strengthening tabs 140 and 150 are bent substantially 90 degrees, and extend substantially in a horizontal direction. These upper end portions are soldered to the under surface of the substrate 110, after the strengthening tabs 140 and 150 are mounted to the housing 90. This strengthens the bond of the slider 1 with the substrate 110. The strengthening tabs 140 and 150 have substantially circular through holes 140*a*.

As shown in FIG. 5A, during the close state, the left and right end portions of the lower stage 73 of the first movable body 70 and those of the lower stage 83 of the second movable body 80 contact the inner circumferential surfaces of the upper wall 94 of the housing 90. This restricts movements of the first movable body 70 and the second movable body 80 in directions away from each other which is caused by the biasing force exerted by the spring 120.

On the other hand, during the separated state, the first movable body 70 and the second movable body 80 are positioned below their positions during the close state, and the lower stage 73 of the first movable body 70 and the lower stage 83 of the second movable body 80 are positioned in a space between the upper wall 94 and the bottom wall 91 of the housing 90, as shown in FIG. 5B. During this state, the lower stages 73 and 83 do not contact the upper wall 94, and there is not restriction to movement of the lower stages 73 and 83 in directions away from each other. When the spring 120 expands and becomes longer than the state in the close state during this state, the first movable body 70 and the second movable body 80 become more distant from each other, than those in the close state.

Note that, as shown in FIG. 6C, the middle stage 72 of the first movable body 70 and the middle stage 82 of the second movable body 80 contact the inner circumferential surface of the upper wall 94 (the middle portion of the upper wall 94 shown in FIG. 5B, where distance between inner periphery portions facing each other is short). Therefore, the first movable body 70 and the second movable body 80 are apart from each other by a predetermined distance, and their further movements in directions away from each other are restricted.

Figure 7B:
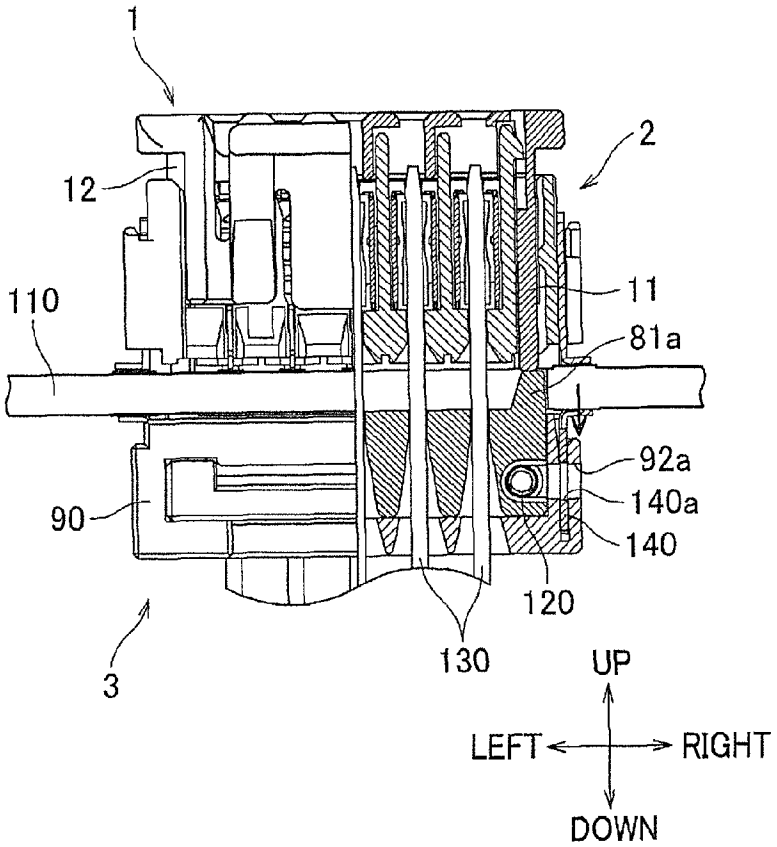
FIGS. 7A and 7B are cross sectional views showing a sequence of assembling the connector.
Figure 7A:
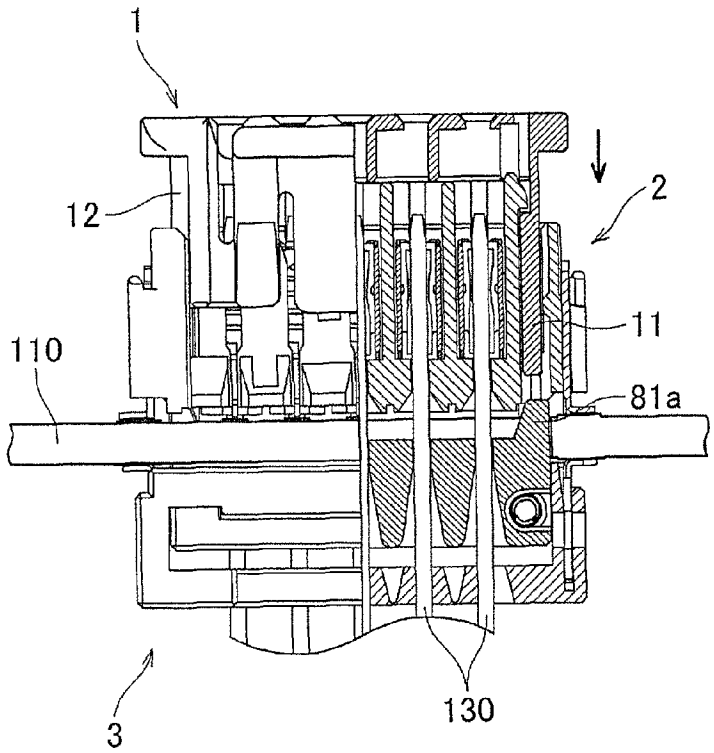

Next, with reference to FIG. 6, and FIG. 7, the following describes a process of making the transition of the close state of the first movable body 70 and the second movable body 80 to the separated state. Here, FIG. 6 is a cross sectional view of FIG. 1 taken along the front/rear directions, and FIG. 7 is a cross sectional view taken along the left/right directions. FIG. 7A and FIG. 7B correspond to FIG. 6B and FIG. 6C, respectively.

First, as shown in FIG. 6A, the female connector 2 is solder-jointed to the substrate 110. At this time, the slider 1 is positioned to cover the top portion of the female connector 2, and the pin 20 is not inserted between the projection of the front wall portion 51 and the bent portion 42 of the female contact 40 (semi-fit state). Further, on the under surface of the substrate 110 is fixed the guide connector 3, and the first movable body 70 and the second movable body 80 are in the close state.

Next, the contact 130 is inserted into the guide connector 3 and the female connector 2 (see FIG. 6B and FIG. 7A). The contact 130 is inserted into the female housing 30, penetrating the substrate 110 from the bottom, through the contact insertion hole 3A of the guide connector 3. The contact 130 is inserted between the projection of the back wall portion 52 and the bent portion 42 of the female contact 40, and is brought into contact with at least one of the back wall portion 52 and the bent portion 42, thus achieving an electrically connection. The contact 130 in the insertion hole 110*a* of the substrate 110, at this time, is close to the upper stage 71 of the first movable body 70 and the upper stage 81 of the second movable body 80. Further, as shown in FIG. 7A, the right wall 11 of the slider 1 is apart from the projection 81*a* of the below-disposed guide connector 3, relative to the up/down directions. Similarly, the left wall 12 of the slider 1 is apart from the projection of the below-disposed guide connector 3, relative to the up/down directions (not shown).

When the slider 1 is pressed down from this state, the right wall 11 of the slider 1 presses down the projections 71*a* and 81*a* of the guide connector 3, as shown in FIG. 6C and FIG. 7B (full-fit state). The guide connector 3 is then pressed down and moves away from the female connector 2. Note that the left wall of the slider 12 shown in FIG. 7B presses the projections of the guide connector 3 in the similar manner. This way, as shown in FIG. 6C, the lower stage 73 of the first movable body 70 and the lower stage 83 of the second movable body 80 move downward, and the outer surfaces of the lower stages 73 and 83 detaches from the upper wall 94. As the result, the spring 120 is expanded, moving the first movable body 70 and the second movable body 80 in directions away from each other, thereby moving away from the contact 130. After that, the middle stage 72 of the first movable body 70 and the middle stage 82 of the second movable body 80 contact the upper wall 94, restricting the further movement of the first movable body 70 and the second movable body 80.

Further, pressing down the slider 1 places the pin 20 between the projection of the front wall portion 51 and the bent portion 42 of the female contact 40, as shown in FIG. 6C. This displaces the bent portion 42 towards the contact 130, thus improving the accessibility between the female contact 40 and the contact 130.

As hereinabove mentioned, the connector 100 of the present embodiment brings about the following effect. Bringing the first movable body 70 and the second movable body 80 into the separated state, while the contact 130 and the female contact 40 are electrically connected, moves away the first movable body 70 and the second movable body 80 from the contact 130. Thus, even when the housing 90 vibrates or when the housing 90 and the substrate 110 vibrate and resonate with each other, the vibration is prevented from being transferred to the contact 130. Therefore, damages to the contact 130 are prevented.

Further, the first movable body 70 and the second movable body 80 are reliably moved away from the contact 130 simply by pressing the projections 71*a* and 71*b* of the first movable body 70 and the projections 81*a* and 81*b* of the second movable body 80 with a use of the slider 1.

The through holes 92*a* and 93*a* on the right wall 92 and the left wall 93 of the housing 90 enable confirmation of the springs 120 being accommodated in the housing 90 through the through holes 92*a* and 93*a*, and contribute to reduction of weight of the guide connector 3. Further, the edge portion of the housing 90 defining the through holes 92*a* and 93*a* makes it easy to carry the guide connector 3, and contributes to efficient assembling of the connector 100.

Further, insertion of the strengthening tabs 140 and 150 into the left and right end portions of the housing 90 reliably accommodates the spring 120 in the housing 90. Further, since the strengthening tabs 140 and 150 closes the through holes 92*a* and 93*a* of the housing 90, foreign matters are kept from entering the housing 90. While the slider 1 is pressed down, the through hole 92*a* of the housing 90, the through hole 140*a* of the strengthening tab 140, and the spring 120 overlap in the left/right directions, as shown in FIG. 7B. This enables confirmation of the spring 120 being accommodated in the housing 90 through the through hole 92*a*.

[Second Embodiment]

Next, the following describes a second embodiment of the present invention, with reference to FIG. 8. The second embodiment is different from the first embodiment essentially in the structures of the guide connector and the biasing member. Note that the same reference symbols are given to members and parts that are identical to those described in the first embodiment, and descriptions for these identical members and parts are omitted as needed. FIG. 8 is a cross sectional view of a right end portion of a connector.

(Slider)

A right wall 211 of the housing of the slider 201 extends in the up/down directions, and the width of a lower portion 211*l* (length relative to the front/rear directions) is narrower than that of the upper portion 211*u*. The leading end portion of the lower portion 211*l* has slant faces and is tapered. The left wall of the housing, as in the right wall 211, has a tapered leading end portion (lower end portion). Note that the right wall 211 and the left wall of the second embodiment are longer relative to the up/down directions than the right wall and the left wall of the housing 10 of the slider 1 of the first embodiment.

(Guide Connector)

The guide connector 203 is made of an insulative resin, and includes a first movable body 270 and a second movable body 280 facing each other relative to the front/rear directions, and a substantially box-like housing (first housing) 290, as shown in FIG. 8A. A contact 130 passes through, from the bottom, a guide hole (not shown) formed on a bottom wall of the housing 290, and is inserted between the first movable body 270 and the second movable body 280. The first movable body 270 and the second movable body 280 have substantially the same structure. Therefore, the following description mainly deals with the first movable body 270, and the description for the second movable body 280 is omitted unless otherwise necessary.

<First Movable Body, Second Movable Body>

As shown in FIG. 8A, the right end portion of the first movable body 270 has a main portion 271 extended in the up/down directions, and a first branching portion 272 and a second branching portion (biasing member) 273 branched off from the lower end of the main portion 271. The first branching portion 272 extends downwards, and its width is reduced as it becomes farther from the main portion 271. The second branching portion 273 on the other hand is bent to form a convex downward. With this structure, the second branching portion 273 is capable of elastically displacing in the front/rear directions. Further, the upper end portion of the main portion 271 has a slant face 271*a* which is declined towards the second movable body 280. The left end portion of the first movable body 270 has the same structure as the right end portion.

The right end portion of the second movable body 280, similarly to the first movable body 270, includes a main portion 281 and a first branching portion 282 and a second branching portion (biasing member) 283 branched off from the lower end of the main portion 281. The upper end portion of the main portion 281 has a slant face 281*a* which is declined towards the first movable body 270. The left end portion of the second movable body 280 has the same structure as the right end portion.

As described above, in the present embodiment, a part of the first movable body 270 and a part of the second movable body 280 serve as a biasing member. The first movable body 270 and the second movable body 280 are disposed symmetrically on the front and back sides so that the first branching portions 272 and 282 face each other.

While the first movable body 270 and the second movable body 280 are accommodated in the housing 290, the second branching portions 273 and 283 expand in the front/rear directions while being in contact with the inner walls of the housing 290, thereby biasing the first movable body 270 and the second movable body 280 in directions towards each other. With this structure, the first movable body 270 and the second movable body 280 are capable of making transition from the close state (see FIG. 8A) to the separated state (see FIG. 8B) in which the movable bodies are made more distant from each other, opposing the biasing force, as compared with those in the close state.

As shown in FIG. 8A, during the close state, the opposing surfaces of the first movable body 270 and the second movable body 280 substantially contact each other. In this state, the opposing surfaces of the first movable body 270 and the second movable body 280 define a contact insertion hole in which the contact 130 is inserted (not shown). The contact insertion hole has a taper area whose diameter decreases as it becomes closer to the upper end. The upper end of the taper area has the smallest diameter of the contact insertion hole; however, is equal to or greater than the diameter of the contact 130.

When the contact 130 is inserted into the contact insertion hole from the bottom, the first movable body 270 and the second movable body 280 are disposed opposite to each other over the contact 130 (see FIG. 8B).

On the other hand in the separated state, the second branching portions 273 and 283 shrinks in the front/rear directions as compared with the close state, as shown in FIG. 8B. The first movable body 270 and the second movable body 280 are apart from each other.

Next, the following describes how the close state of the first movable body 270 and the second movable body 280 is transited to the separated state.

FIG. 8A shows the slider 1 in a semi-fit state with respect to the female connector 2. The female connector 2 is solder-jointed to the substrate 310. Further, to the female connector 2 is inserted from the bottom the contact 130 having penetrated through the substrate 310. The contact 130 and the female contact are electrically connected. At this time, the first movable body 270 and the second movable body 280 are in the close state. Further, the right wall 211 of the slider is positioned above the first movable body 270 and the second movable body 280.

When the slider 201 is pressed downward from this state, the right wall 211 of the slider 201 presses downward the slant face 271*a* of the first movable body 270 and the slant face 281*a* of the second movable body 280. Then, components of force relative to the front/rear directions are exerted on each of the main portions 271 and 281 (a component of force relative to the front direction is exerted on the main portion 271 and a component of force relative to the rear direction is exerted on the main portion 281). This causes the second branching portions 273 and 283 to contract, thus causing the first movable body 270 and the second movable body 280 to move away from the contact (separated state, see FIG. 8B).

When the slider 201 is pulled upward from the state shown in FIG. 8B, to the top of the main portions 271 and 281, the components of force relative to the front/rear directions are no longer exerted on the main portions 271 and 281. Then, the second branching portions 273 and 283 expand, and causes the first movable body 270 and the second movable body 280 to move in directions toward each other (close state, see FIG. 8A).

As hereinabove described, in the present embodiment, when the contact 130 and the female contact 40 are electrically connected, the first movable body 270 and the second movable body 280 are kept away from the contact 130, as in the first embodiment. Therefore, even when the housing 290 vibrates or when the housing 290 and the substrate 310 vibrate and resonate with each other, the vibration is prevented from being transferred to the contact 130. Therefore, damages to the contact 130 are prevented.

Further, to move away the first movable body 270 and the second movable body 280 from the contact 130, it simply requires formation of the slant faces 271*a* and 281*a* on the upper portions of the first movable body 270 and the second movable body 280, respectively, and pressing the slant faces 271*a* and 281*a* with the slider 201.

Thus, embodiments of the present invention are described hereinabove with reference to attached drawings. It should be however noted that specific structure of the present invention is not limited to these embodiments. The scope of the present invention is defined by claims, not by the above description, and shall encompass all changes that fall within the equivalent meaning and scope of the claims.

For example, in the first embodiment, the through holes 92*a* and 93*a* are formed on the right wall 92 and the left wall 93 of the housing 90 of the guide connector 3; however, the housing 90 does not necessarily have the through holes 92*a* and 93*a*. Further, in the second embodiment, a through hole may be formed on each of the right wall and the left wall of the housing 290 of the guide connector 203.

Further, in the first embodiment, the strengthening tabs (insertion members) 140 and 150 are inserted in the left and right end portions of the housing 90, respectively; however, it is not necessary to insert the strengthening tabs 140 and 150. Further, in the second embodiment, a strengthening tab may be inserted in each of the left and right end portions of the housing 290.

In the first embodiment and the second embodiment, the guide connectors 3 and 203 have the same structure; however, their structures may be different from each other. The same goes for the first movable bodies 70 and 270, and for the second movable bodies 80 and 280.

The biasing member is the spring 120 in the first embodiment, and is a part of the first movable body 270 and a part of the second movable body 280 in the second embodiment bent to form a convex; however, the biasing member is not limited to those, and may be altered. For example, an elastic member such as rubber or the like may be used for the biasing member.

Further, in the first embodiment, the first movable body 70, the second movable body 80, and the biasing member (spring 120) are separate members; however, these members may be formed in one piece as in the case of the second embodiment. Further, in the second embodiment, the biasing member was a part of the first movable body 270 and a part of the second movable body 280; however, the biasing member may be a separate member. For example, a spring may be arranged between the first movable body 270 and the housing 290, and between the second movable body 280 and the housing 290.

Further, in the second embodiment, the first movable body 270 and the second movable body 280 are pressed with the slider 201; however, the slider 201 may press only one of the first movable body 270 and the second movable body 280. Such a structure also causes the pressed movable body to move away from the contact 130. Therefore, vibration of the contact 130 is restrained and damages to the contact 130 are prevented.

Further, in the second embodiment, the leading end of the right wall 211 and that of the left wall of the slider 201 are each tapered; however, the right wall 211 and the left wall do not have to be tapered.

REFERENCE NUMERALS

1 Slider
2 Female Connector (Second Connector)
3, 203 Guide Connector (First Connector)
30 Female Housing (Second Housing)
40 Female Contact (Second Contact)
70, 270 First Movable Body
80, 280 Second Movable Body
90, 290 Housing (First Housing)
92*a*, 93*a* Through Hole
120 Spring(Biasing Member)
100 Connector
110 Substrate
130 Contact (First Contact)
140, 150 Strengthening Tab (Insertion Member)
273, 283 Second Branching Portion (Biasing Member)
110*a* Insertion Hole (Contact Insertion Hole)

What is claimed is:

1. A connector, comprising: a first connector and a second connector interposing therebetween a substrate, the first connector and the second connector being arranged across from each other over the substrate, and a slider movably attached to the second connector, wherein the first connector comprises a first housing configured to accommodate a first movable body and a second movable body to interpose therebetween a first contact extending in a direction perpendicular to the substrate, and a biasing member capable of biasing the first movable body and the second movable body in directions away from each other, wherein the first movable body and the second movable body accommodated in the first housing are capable of making a transition from a close state to a separated state, the close state being a state in which movement of the first movable body and the second movable body in directions away from each other is restricted by the first housing, while the first movable body and the second movable body are biased by the biasing member, the separated state being a state in which the first movable body and the second movable body are made more distant from the second connector and from each other than the close state by means of the biasing member, and wherein the first movable body and the second movable body, during the close state, form a contact insertion hole whose diameter becomes smaller as it gets closer to the substrate, and whose smallest diameter is not smaller than a diameter of the first contact, wherein the second connector comprises a second housing, and a second contact attached to the second housing, which contact is to be electrically connected to the first contact having penetrated the contact insertion hole and the substrate, and wherein moving the slider while the first contact penetrates the contact insertion hole and the substrate and is electrically connected to the second contact causes transition from the close state to the separated state of the first movable body and the second movable body.

2. The connector according to claim 1, wherein pressing the first movable body and the second movable body with a use of the slider causes the transition from the close state to the separated state of the first movable body and the second movable body.

3. A connector, comprising: a first connector and a second connector interposing therebetween a substrate, the first connector and the second connector being arranged across from each other over the substrate, and a slider movably attached to the second connector, wherein the first connector comprises a first housing configured to accommodate a first movable body and a second movable body to interpose a first contact extending in a direction perpendicular to the substrate, a biasing member capable of biasing the first movable body and the second movable body in directions toward each other, wherein the first movable body and the second movable body accommodated in the first housing are capable of making a transition from a close state to a separated state, the close state being a state in which the first movable body and the second movable body are biased by the biasing member, the separated state being a state in which the first movable body and the second movable body are made more distant from each other than the close state, opposing against the force for biasing the first movable body and the second movable body exerted by the biasing member, and wherein the first movable body and the second movable body, during the close state, form a contact insertion hole whose diameter becomes smaller as it gets closer to the substrate, and whose smallest diameter is not smaller than a diameter of the first contact, wherein the second connector comprises a second housing, and a second contact attached to the second housing, which contact is to be electrically connected to the first contact having penetrated the contact insertion hole and the substrate, and wherein moving the slider while the first contact penetrates the contact insertion hole and the substrate and is electrically connected to the second contact causes transition from the close state to the separated state of the first movable body and the second movable body.

4. The connector according to claim 3, wherein pressing at least one of the first movable body and the second movable body with a use of the slider causes the transition from the close state to the separated state of the first movable body and the second movable body.

5. The connector according to claim 1, wherein the biasing member is accommodated in the first housing, and the first housing has a through hole formed in a position to face the biasing member.

6. The connector according to claim 2, wherein the biasing member is accommodated in the first housing, and the first housing has a through hole formed in a position to face the biasing member.

7. The connector according to claim 3, wherein the biasing member is accommodated in the first housing, and the first housing has a through hole formed in a position to face the biasing member.

8. The connector according to claim 4, wherein the biasing member is accommodated in the first housing, and the first housing has a through hole formed in a position to face the biasing member.

9. The connector according to claim 5, further comprising an insertion member disposed between the first housing and the biasing member, in a position to overlap at least a portion of the through hole.

10. The connector according to claim 6, further comprising an insertion member disposed between the first housing and the biasing member, in a position to overlap at least a portion of the through hole.

11. The connector according to claim 7, further comprising an insertion member disposed between the first housing and the biasing member, in a position to overlap at least a portion of the through hole.

12. The connector according to claim 8, further comprising an insertion member disposed between the first housing and the biasing member, in a position to overlap at least a portion of the through hole.

* * * * *